US011415368B2

(12) United States Patent
Mochizuki

(10) Patent No.: US 11,415,368 B2
(45) Date of Patent: Aug. 16, 2022

(54) MELTING AND HOLDING FURNACE

(71) Applicant: TOUNETSU CO., LTD., Fujinomiya (JP)

(72) Inventor: Kiyata Mochizuki, Fujinomiya (JP)

(73) Assignee: TOUNETSU CO., LTD., Fujinomiya (JP)

( * ) Notice: Subject to any disclaimer, the term of this patent is extended or adjusted under 35 U.S.C. 154(b) by 0 days.

(21) Appl. No.: 17/250,869

(22) PCT Filed: Sep. 19, 2019

(86) PCT No.: PCT/JP2019/036658

§ 371 (c)(1),
(2) Date: Mar. 16, 2021

(87) PCT Pub. No.: WO2020/080027

PCT Pub. Date: Apr. 23, 2020

(65) Prior Publication Data

US 2022/0042742 A1 Feb. 10, 2022

(30) Foreign Application Priority Data

Oct. 19, 2018 (JP) ..... JP2018-197454

(51) Int. Cl.
*F27B 3/04* (2006.01)
*F27D 21/00* (2006.01)
(Continued)

(52) U.S. Cl.
CPC ..... *F27B 3/045* (2013.01); *F27D 1/18* (2013.01); *F27D 21/0028* (2013.01); *F27D 2019/0071* (2013.01); *F27D 2019/0075* (2013.01)

(58) Field of Classification Search
CPC . B22D 41/00; F27B 3/04; F27B 3/045; F27D 19/00; F27D 1/18; F27D 21/0028; F27D 3/14
(Continued)

(56) References Cited

U.S. PATENT DOCUMENTS 4,850,577 A * 7/1989 Yamaoka ..... F27B 3/045 266/229
4,881,670 A * 11/1989 Yamaoka ..... F27B 1/025 266/239
(Continued)

FOREIGN PATENT DOCUMENTS

JP S60237772 2/1985
JP S60507953 4/1985
(Continued)

*Primary Examiner* — Scott R Kastler
*Assistant Examiner* — Michael Aboagye
(74) *Attorney, Agent, or Firm* — Fay Kaplun & Marcin, LLP.

(57) ABSTRACT

A melting and holding furnace includes a main body and a material input mechanism supplying a molten metal to the body which includes a melting chamber; a molten metal receiving chamber; a pumping-out chamber; and a molten metal heating mechanism. The input mechanism includes a molten-metal surface level sensor to detect that the surface height position of the metal in the pumping-out chamber has reached a lower limit that is set to be above the lower surface height position of a lid of the melting chamber, and is set to supply the receiving chamber with the metal and/or the metal block when the sensor detects that the surface height position of the metal in the pumping-out chamber has reached the lower limit so that the surface height position of the metal in the pumping-out chamber is always kept above the lower surface height position of the lid.

3 Claims, 3 Drawing Sheets

(51) Int. Cl.
*F27D 1/18* (2006.01)
*F27D 19/00* (2006.01)

(58) Field of Classification Search
USPC ..... 266/94, 236, 95, 99, 242, 900; 222/590, 222/593; 164/4.1, 68.1, 141, 151.3, 164/151.4; 432/156, 159, 161, 214
See application file for complete search history.

(56) References Cited

U.S. PATENT DOCUMENTS 5,662,859 A * 9/1997 Noda ..... F27D 3/14 266/239
5,700,422 A * 12/1997 Usui ..... B22D 39/023 266/239
6,451,246 B2 * 9/2002 Hatano ..... C23C 2/003 266/235
7,790,098 B2 * 9/2010 Mochizuki ..... B22D 39/02 266/89
2002/0185789 A1 12/2002 Klingensmith et al.

FOREIGN PATENT DOCUMENTS

JP S6412197 S 1/1989
JP S64121964 1/1989
JP H5443626 6/1993
JP H113200831 11/1999
JP 20023573871 12/2002
JP 2005076972 * 3/2005 ..... F27D 21/0028
JP 20050769721 3/2005
JP 2005-118885 5/2005
JP 20110751871 4/2011
JP 59892661 9/2016
JP 2018058101 * 4/2018 ..... F27D 1/18
JP 20180581011 4/2018

* cited by examiner

MELTING AND HOLDING FURNACE

PRIORITY CLAIM

This application is a National Phase application filed under 35 U.S.C. § 371 of PCT Patent Application Serial No. PCT/JP2019/036658 filed on Sep. 19, 2019, entitled "Melting and Holding Furnace" which claims priority to JP Patent Appln. Serial No. 2018-197454; the specifications of both applications are hereby incorporated by reference in their entirety.

FIELD OF THE INVENTION

The present invention relates to a melting and holding furnace that is used for heating and melting molten metal such as, for example, aluminum, aluminum alloy, or the like and for holding and supplying it to a casting machine or the like.

BACKGROUND INFORMATION

Conventionally, a melting and holding furnace and a molten-metal holding furnace have been used in order to heat and hold molten metal such as, for example, aluminum, aluminum alloy, or the like to be casted.

For example, Patent document 1 discloses a melting and holding furnace including: an immersion-type burner that is attached through a supporting plate to a ceiling portion of a furnace body in a melting chamber; a first storage chamber for melting and storing a metal block; and a second storage chamber for storing the molten metal transferred from the first storage chamber after being purified through two pieces of ceramic filters and then for supplying the molten metal to a casting machine through a molten metal supplying apparatus that is attached thereto.

In addition, Patent document 2 discloses a molten-metal holding furnace including: a molten-metal storage container having a molten-metal holding chamber and a pressurizing chamber, wherein a level sensor is suspended from a holding chamber lid of the molten-metal holding chamber in order to detect an upper-limit surface level of molten metal in the molten-metal holding chamber, wherein tube heaters are equipped inside each of the molten-metal holding chamber and the pressurizing chamber, wherein the pressurizing chamber includes a pressurizing part and a molten metal output part, into which the molten metal is flown from the molten-metal holding chamber through a lifting cutoff valve, and wherein there is a ventilating portion that is located above a fixed surface position of the molten metal in the portions except the pressurizing part in the pressurizing chamber of the molten-metal storage container, through which pressurized gas is released to the atmosphere.

PRIOR ART DOCUMENTS

Patent Documents

[Patent document 1] Japanese Unexamined Patent Application Publication No. H11-320083
[Patent document 2] Japanese Patent No. 5989266

SUMMARY

In the conventional technology as shown in FIG. 3, a melting furnace main body 102 of a melting and holding furnace 101 includes: a melting chamber 104 for holding molten metal M; a molten metal receiving chamber 105 that is in communication with the melting chamber 104 and is supplied with the molten metal M; a pumping-out chamber 106 that is in communication with the melting chamber 104 and is capable of tapping the molten metal M that is introduced from the melting chamber 104 into an external casting machine; and an immersion burner 109 (or an immersion heater) for heating the molten metal M in the melting chamber 104. In such a conventional melting and holding furnace 101, a space may be formed between the upper lid 108 and the molten metal M in the melting chamber 104 where air AR can be present. This air AR may then oxidize the molten metal M during heating to form an oxide OX (aluminum oxide, alumina, or the like), which may adhere to an inner wall of the melting chamber 104 or a surface of the immersion burner 109 (or the immersion heater). Since such an oxide OX may also be mixed into the molten metal M, the molten metal M has to be purified through a ceramic filter 110 to obtain highly purified molten metal before being flown into and held in the pumping-out chamber 106. In addition, such molten metal M has to be supplied from an inner part of the molten metal M through the molten metal supplying apparatus to the casting machine so that it is prevented from being exposed to the atmosphere.

In the conventional technology of the molten-metal holding furnace described in the above Patent document 2, the portions that remain not sealed except the pressurizing part having a fully sealed structure in the pressurizing chamber are just fasten with bolts that are properly spaced from each other, that is, both a ceiling portion of a ceiling plate and that of an iron shell are just fasten to a side wall portion with bolts. These portions allow gaps to be formed that can serve as ventilating parts located above the fixed surface of the molten metal, which enables pressurized gas to be released from the furnace to the outside. In this way, the gas has been prevented from mixing into the molten metal and thus forming bubbles.

Regarding the above Patent documents 1 and 2, it should be noted that there is a common portion that has not been focused with reference to FIG. 3. That portion is a space itself that is formed between the upper lid 108 of the melting chamber 104 and the molten metal M. Considering the structure of the melting chamber 104, although the space between the upper lid 108 and the molten metal M where the air AR can be present as in the conventional embodiment can be accepted as a part to be heated by radiant heat from above together with the molten metal M, it is also regarded as a problem since the air AR can form an oxide OX, therefore a countermeasure for which has been taken with attention.

In addition, in the recent trend in the automobile industry for example, the internal-combustion engine, which is a main automobile component, has been increasingly replaced by a motor due to the rapid shifting to electric vehicles (EVs). Since the internal-combustion engine generates the motive power by a combustion reaction causing vibration by piston movement, cast components for an automobile body are required to have a thickness for strength that can withstand the vibration contrary to an aim of realizing a lightweight automobile body, thus imposing a limit on the weight reduction. By contrast, since the EV motor does not cause the vibration by piston, thin and lightweight cast components can be employed for a case for housing a motor, a battery, or the like around the engine. The vehicle weight reduction in accordance with the shift to the EVs can lead to reduced battery consumption in a motor, which can prolong the life of a battery, thereby saving the energy. In view of these facts, it is thought that cast components used in many of automobile body components would be demanded to reduce the weight for realizing a lightweight automobile body. That is, the cast products would need to be thinner. However, in the case of a thin-wall casting, if an oxide is present in molten metal during casting, the probability to have faulty products may become higher compared with the case of conventional cast products that don't have to be thin-wall casted. In this respect, it can be said that it is difficult to realize more effects aiming at reduction of metal loss during melting, improvement of molten metal quality, and reduction of energy cost related to product quality, which are the effects of reducing oxide formation further, in the process of producing thin-walled casted products by the conventional technologies described in the above Patent Document 1 and Patent Document 2 intended for casting components for the automobiles that run on the internal-combustion engine.

The present invention relates to a melting and holding furnace that may suppress the formation of an oxide with a relatively simple configuration, thus, improving the production efficiency while reducing the running cost. In addition, the present invention relates to sustainably providing molten metal having a high quality with less oxidation.

Means for Solving the Problems

The present invention is mainly characterized by including a melting chamber as a component of a melting furnace main body that does not allow a space to be formed between an upper lid and a surface of molten metal in order to solve the aforementioned problems. For the reason described above, the present invention adopts the following configuration. Specifically, a melting and holding furnace according to a first aspect of the present invention comprises: a melting furnace main body and a material input mechanism for supplying at least one of molten metal and a metal block to the melting furnace main body, the melting furnace main body including: a melting chamber for holding the molten metal; a molten metal receiving chamber that is in communication with the melting chamber and is supplied with at least one of the molten metal and the metal block from the material input mechanism; a pumping-out chamber that is in communication with the melting chamber and is capable of tapping the molten metal that is introduced from the melting chamber into an external casting machine; and a molten metal heating mechanism for heating the molten metal in the melting chamber, wherein the melting chamber includes a melting chamber lid that is installed so as to seal an upper opening without forming a space between the surface of the molten metal and itself, and wherein the material input mechanism includes a molten-metal surface level sensor that is configured to at least detect that the surface height position of the molten metal in the pumping-out chamber has reached a lower limit that is set to be above the lower surface height position of the melting chamber lid, and is set to supply the molten metal receiving chamber with at least one of the molten metal and the metal block when the molten-metal surface level sensor detects that the surface height position of the molten metal in the pumping-out chamber has reached the lower limit so that the surface height position of the molten metal in the pumping-out chamber is always kept above the lower surface height position of the melting chamber lid.

In this melting and holding furnace, the material input mechanism is set to supply the molten metal receiving chamber with at least one of the molten metal and the metal block when the molten-metal surface level sensor detects that the surface height position of the molten metal in the pumping-out chamber has reached the lower limit so that the surface height position of the molten metal in the pumping-out chamber is always kept above the lower surface height position of the melting chamber lid. Thus, since the melting chamber is always filled up with the molten metal to the lower surface of the melting chamber lid, which does not allow a space to be formed therein where a gas such as air can be present, the molten metal is prevented from being exposed to the air in the melting chamber, and thus from being oxidized during heating of the molten metal.

A melting and holding furnace according to a second aspect of the present invention is characterized by the melting and holding furnace according to the first aspect, wherein the molten metal heating mechanism includes an immersion burner or an immersion heater that is configured to be immersed into the molten metal in the melting chamber on a tip end side thereof, and wherein the immersion burner or the immersion heater is installed so as to extend through the melting chamber lid from above or to extend laterally through an external side wall portion of the melting chamber near the bottom of the melting chamber as a horizontal immersion type.

Specifically, in this melting and holding furnace, since the immersion burner or the immersion heater is installed so as to extend through the melting chamber lid from above or to extend laterally through the external side wall portion of the melting chamber near the bottom of the melting chamber as a horizontal immersion type, the whole of the immersion burner or the immersion heater in the melting chamber can be always immersed into the molten metal, which can increase the heat transfer coefficient to the molten metal in the melting chamber. Therefore, the molten metal can be heated with less energy spent on increasing the temperature and with less oxidation compared with the conventional technologies, thereby increasing the productivity of products during a casting process.

A melting and holding furnace according to a third aspect of the present invention is characterized by the melting and holding furnace according to the first or second aspect, wherein the upper opening of the melting chamber has an inclined inner peripheral surface that is configured to have an opening area that becomes gradually larger toward the upper side, while the melting chamber lid has an inclined outer peripheral surface corresponding to the inner peripheral surface of the upper opening so that it can be fit into the upper opening from above.

Specifically, in this melting and holding furnace, the upper opening of the melting chamber has an inclined inner peripheral surface that is configured to have an opening area that becomes gradually larger toward the upper side, while the melting chamber lid has an inclined outer peripheral surface corresponding to the inner peripheral surface of the upper opening so that it can be fit into the upper opening from above. This configuration can make it difficult to form a gap between the upper opening and the melting chamber lid when they are fit together compared with the one having vertical inner and outer peripheral surfaces, thereby preventing the molten metal from being oxidized. Besides, this configuration enables the upper opening to be readily sealed only by fitting the melting chamber lid into the upper opening from above.

The present invention provides a number of advantages. Some of the advantages are described below.

Specifically, according to the melting and holding furnace of the present invention, since the material input mechanism is set to supply the molten metal receiving chamber with at least one of the molten metal and the metal block when the molten-metal surface level sensor detects that the surface height position of the molten metal in the pumping-out chamber has reached the lower limit so that the surface height position of the molten metal in the pumping-out chamber is always kept above the lower surface height position of the melting chamber lid, the melting chamber is always filled up with the molten metal, thereby preventing the molten metal from being exposed to air, and thus from being oxidized.

Therefore, the melting and holding furnace of the present invention can suppress the formation of an oxide with a relatively simple configuration, thus satisfactorily maintaining the quality of molten metal and the productivity of products.

DETAILED DESCRIPTION

Hereinafter, a melting and holding furnace according to a first embodiment of the present invention will be described with reference to FIG. 1.

Figure 1:
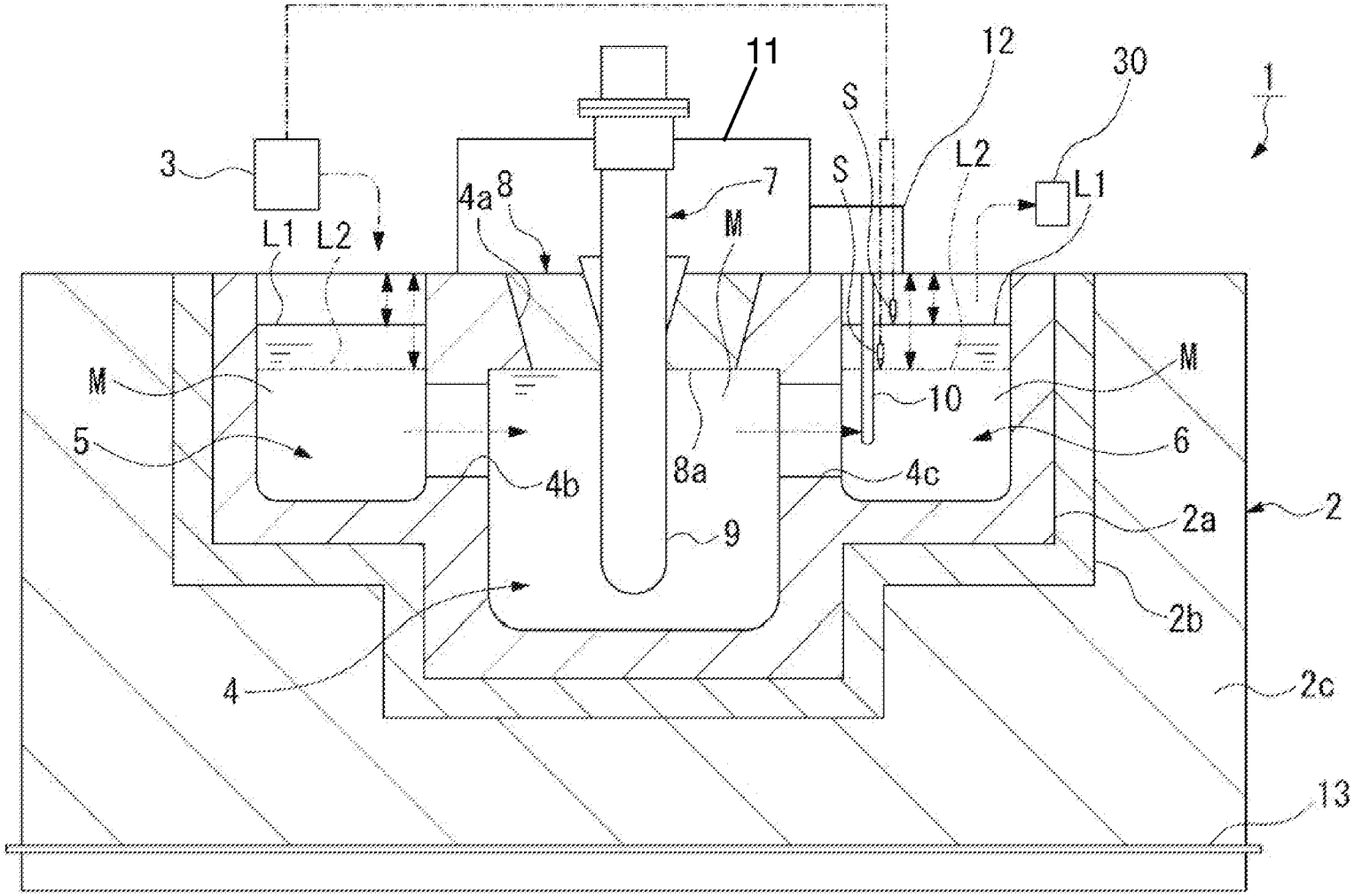
FIG. 1 is a cross-sectional view showing a melting and holding furnace according to a first embodiment of the present invention.

As shown in FIG. 1, a melting and holding furnace 1 according to the present embodiment includes a melting furnace main body 2 and a material input mechanism 3 for supplying at least one of molten metal M and a metal block such as aluminum, aluminum alloy, or the like to the melting furnace main body 2.

The melting furnace main body 2 includes a melting chamber 4 for holding the molten metal M, a molten metal receiving chamber 5 that is in communication with the melting chamber 4 and is supplied with at least one of the molten metal M and the metal block from the material input mechanism 3, a pumping-out chamber 6 that is in communication with the melting chamber 4 and is capable of tapping the molten metal M that is introduced from the melting chamber 4 into an external casting machine 30, and a molten metal heating mechanism 7 for heating the molten metal M in the melting chamber 4.

Note that the metal block described above includes metal ingot.

The melting chamber 4 includes a melting chamber lid 8 that is installed so as to seal an upper opening 4*a*.

In the present embodiment, the melting chamber lid 8 is made of a selected material having a poor wettability.

The material input mechanism 3 includes a molten-metal surface level sensor S that is configured to at least detect that the surface height position of the molten metal M in the pumping-out chamber 6 has reached the lower limit that is set to be above the lower surface height position of the melting chamber lid 8.

In the present embodiment, the molten-metal surface level sensor S is installed on each of the upper and lower limit levels of the surface height position of the molten metal M. Thus, since the molten-metal surface level sensors S are provided in pairs, it can detect when the surface height position of the molten metal M has reached not only the lower limit level but also the upper limit level.

The material input mechanism 3 is set to supply the molten metal receiving chamber 5 with at least one of the molten metal M and the metal block when the molten-metal surface level sensor S detects that the surface height position of the molten metal in the pumping-out chamber 6 has reached the lower limit so that the molten metal surface height position in the pumping-out chamber 6 is always kept above the lower surface height position of the melting chamber lid 8. Specifically, the molten metal M is filled in the melting chamber 4 so that it is always in contact with a lower surface 8*a* of the melting chamber lid 8.

As the material input mechanism 3, a known mechanism can be employed using a molten metal conveying method or the like for supplying the molten metal M by pouring it into the molten metal receiving chamber 5 through a trough from a melting furnace located at a remote place, for example.

The molten metal heating mechanism 7 includes an immersion burner 9 that is configured to be immersed into the molten metal M in the melting chamber 4 on the tip end side thereof.

The immersion burner 9 is installed so as to extend through the melting chamber lid 8 from above.

The immersion burner 9 is, for example, a burner that heats the molten metal M by igniting in a ceramic tube that is immersed into the molten metal M and has a structure that allows exhaust from its center. Since such a burner is installed in the melting chamber 4 having a structure that does not allow a space to be formed between the melting chamber lid 8 and the molten metal M, it is kept in a fully immersed state.

Note that an immersion heater of an electric heating type may be employed instead of the immersion burner 9.

The upper opening 4*a* of the melting chamber 4 has an inclined inner peripheral surface that is configured to have an opening area that becomes gradually larger toward the upper side.

In addition, the melting chamber lid 8 has an inclined outer peripheral surface corresponding to the inner peripheral surface of the upper opening 4*a* so that it can be fit into the upper opening 4*a* from above. This configuration can make it difficult to form a gap between the inner peripheral surface of the upper opening 4*a* and the outer peripheral surface when they are fit together, thereby preventing the molten metal from being oxidized. Besides, this configuration can prevent the melting chamber lid 8 from falling to the bottom of the furnace in the melting chamber 4 when the melting chamber lid 8 is lifted and removed for its maintenance.

In the present embodiment, each of the upper opening 4*a* and the melting chamber lid 8 has an inverted cone shape.

The molten metal receiving chamber 5 and the melting chamber 4 are in communication with each other through a molten-metal-receiving-side communicating hole 4*b* on one side wall portion, while the pumping-out chamber 6 and the melting chamber 4 are in communication with each other through a pumping-outside communicating hole 4*c* on the other side wall portion.

The molten metal receiving chamber 5, the melting chamber 4, and the pumping-out chamber 6 consisting the melting furnace main body 2 are made of three furnace-body refractory layers.

The three furnace-body refractory layers are composed of a refractory material wall 2*a*, which constitutes the inner walls of the molten metal receiving chamber 5, the melting chamber 4, and the pumping-out chamber 6 and which is made of a shapeless refractory material such as granular alumina or the like; a backing material layer 2*b*, which is a refractory layer made of alumina or the like that covers the outer surface of the refractory material wall 2*a*; and a heat insulating material layer 2*c*, which is constructed by attaching a refractory fabric to the backing material layer 2*b* so as to cover and support it. Note that parts of the outer periphery, bottom and top surfaces of the heat insulating material layer 2*c* are covered with an iron shell 13.

In the pumping-out chamber 6, a molten metal thermocouple 10 is suspended from above with the lower portion thereof being inserted into the molten metal M in the pumping-out chamber 6.

The molten metal thermocouple 10 is intended for measuring a temperature of the molten metal M so as to keep the temperature setting suitable for casting. Specifically, according to the temperature of the molten metal M detected by the molten metal thermocouple 10, the molten metal M is heated by the immersion burner 9 so that the predetermined temperature (e.g., 660 to 750° C.) can be maintained.

The molten-metal surface level sensor S is configured to be suspended with the detection end thereof perpendicularly extending up to the surface of the molten metal M in the pumping-out chamber 6 in order to detect a molten metal surface level of the molten metal M in the pumping-out chamber 6. The surface level of the molten metal in the pumping-out chamber 6 that is detected by this molten-metal surface level sensor S is output to the material input mechanism 3.

The material input mechanism 3 is configured to control input of at least one of the molten metal M and the metal block so that the surface level of the molten metal in the pumping-out chamber 6 is kept higher than the lower surface 8*a* of the melting chamber lid 8. Specifically, the molten-metal surface level sensor S is configured to detect when the surface level of the molten metal in the pumping-out chamber 6 has reached the lower surface level and is approaching to the lower surface 8*a* of the melting chamber lid 8 (e.g., a molten metal surface level L2), and the material input mechanism 3 is configured to input at least one of the molten metal M and the metal block to the molten metal receiving chamber 5 until the time when the molten-metal surface level sensor S detects that the surface level of the molten metal has been raised up to the upper limit level (e.g., a molten metal surface level L1) that is above the height position of the lower surface 8*a* of the melting chamber lid 8.

Both of the molten metal thermocouple 10 and the molten-metal surface level sensor S are suspended in the pumping-out chamber 6 with their upper portions being supported on a sensor mounting lid portion 12 provided on the upper portion of the pumping-out chamber 6.

On the upper portion of the melting chamber 4, a melting chamber lid cover 11 is provided so as to cover the upper portion of the melting chamber lid 8 and to support the upper portion of the immersion burner 9.

Note that a circulation chamber may be provided between the molten metal receiving chamber 5 and the melting chamber 4, which may include an impeller for circulating the molten metal therein.

As described above, in the melting and holding furnace 1 according to the first embodiment, the material input mechanism 3 is configured to supply at least one of the molten metal M and the metal block to the molten metal receiving chamber 5 when the molten-metal surface level sensor S detects that the surface height position of the molten metal in the pumping-out chamber 6 has reached the lower limit so that the surface height position of the molten metal in the pumping-out chamber 6 is always kept above the lower surface height position of the melting chamber lid 8. Therefore, the molten metal M is always filled up to the lower surface of the melting chamber lid 8, thereby preventing the molten metal M from being exposed to the air in the melting chamber 4, and thus from being oxidized during heating of the molten metal M.

In addition, since the immersion burner 9 is installed so as to extend through the melting chamber lid 8 from above, the whole of the immersion burner 9 in the melting chamber 4 can be always immersed into the molten metal M, which can increase the heat transfer coefficient to the molten metal. Thus, the molten metal M can be heated with less energy spent on increasing the temperature and with less oxidation compared with the conventional technologies, thereby increasing the productivity of products during a casting process.

Furthermore, the upper opening 4*a* of the melting chamber 4 has an inclined inner peripheral surface that is configured to have an opening area that becomes gradually larger toward the upper side, while the melting chamber lid 8 has an inclined outer peripheral surface corresponding to the inner peripheral surface of the upper opening 4*a* so that it can be fit into the upper opening 4*a* from above. This configuration can make it difficult to form a gap between the upper opening and the melting chamber lid when they are fit together compared with the one having vertical inner and outer peripheral surfaces, thereby preventing the molten metal from being oxidized. Besides, this configuration enables the upper opening 4*a* to be readily sealed only by fitting the melting chamber lid 8 into the upper opening 4*a* from above.

Figure 2:
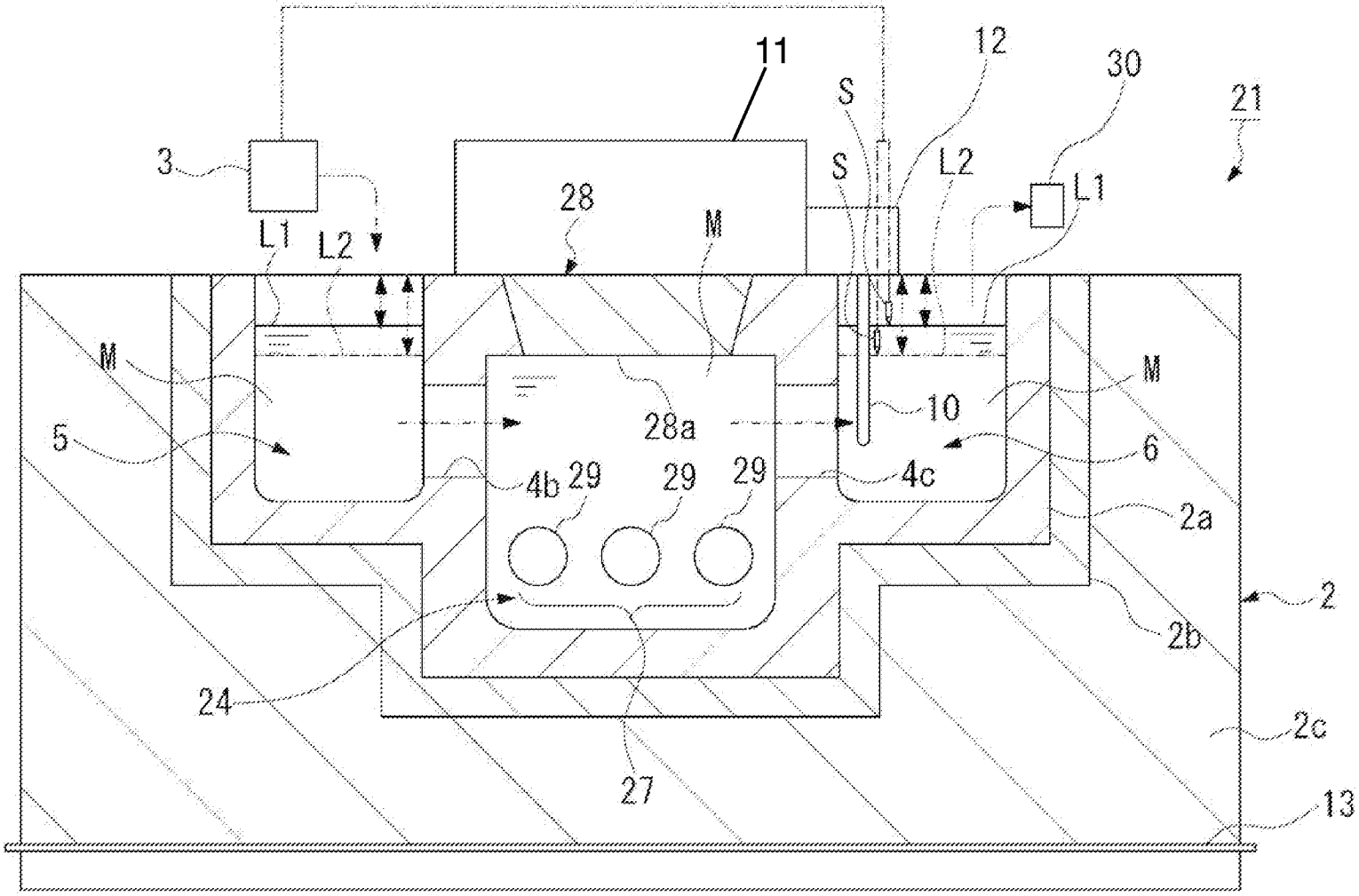
FIG. 2 is a cross-sectional view showing a melting and holding furnace according to a second embodiment of the present invention.
Figure 3:
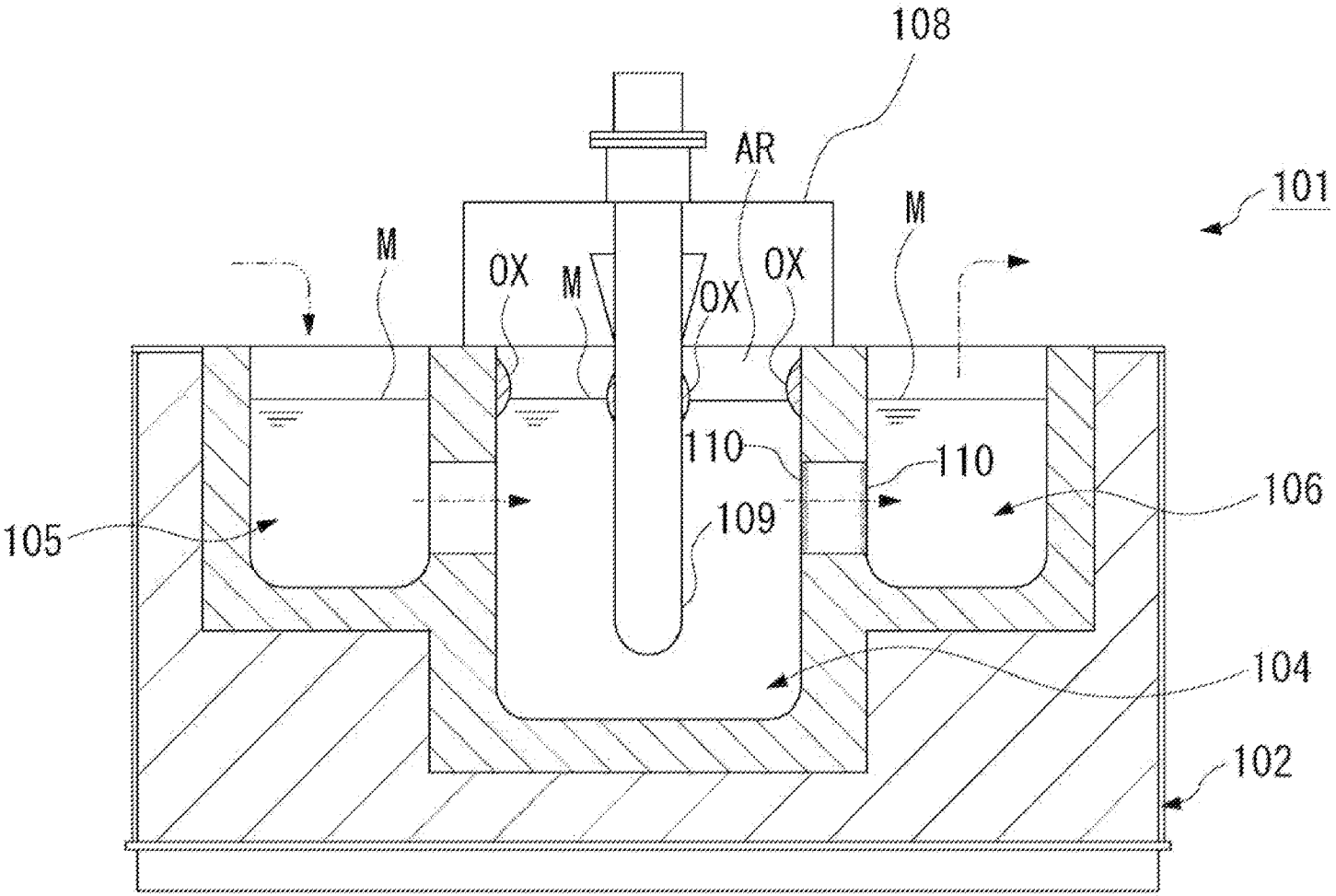
Fig. 3 PRIOR ART
FIG. 3 is a cross-sectional view showing an example of a conventional melting and holding furnace with respect to the present invention.

Next, a melting and holding furnace according to a second embodiment of the present invention will be described below with reference to FIG. 2. Note that, in the following description of the second embodiment, the same components as those in the first embodiment described above are denoted by the same reference numerals, and thus the description thereof is omitted.

The second embodiment is different from the first embodiment in the following points. The molten metal heating mechanism 7 according to the first embodiment is of an upper-immersion type employing the immersion burner 9 that is configured to be immersed into the molten metal M with the immersion burner 9 extending through the melting chamber lid 8 from above, whereas the melting and holding furnace 21 according to the second embodiment employs, as shown in FIG. 2, the molten metal heating mechanism 27 of an under-heater type including three immersion heaters 29 of a horizontal immersion type that are configured to be immersed into the molten metal with the immersion heaters 29 laterally extending from an external side wall portion of the melting chamber 24 near the bottom of the melting chamber 24.

Specifically, the molten metal heating mechanism 27 according to the second embodiment is of a horizontal immersion type including the immersion heaters 29 that are configured to laterally extend from an external side wall portion of the melting chamber 24. Therefore, in the second embodiment, since the immersion heaters 29 are not supported on the melting chamber lid 28 with the immersion heaters 29 extending therethrough, the melting chamber lid 28 has a simple structure compared with that in the first embodiment.

Even in the melting and holding furnace 21 according to this second embodiment, since the surface level of the molten metal M can be controlled so that the molten metal M is always in touch with the lower surface 28*a* of the melting chamber lid 28 as in the first embodiment, the formation of an oxide can be suppressed in the melting chamber 28.

Note that the immersion burner 9 of a horizontal immersion type may be employed instead of the immersion heaters 29 according to the heating performance of molten metal.

The technical scope of the present invention is not limited to the aforementioned embodiments, but the present invention may be modified in various ways without departing from the scope or teaching of the present invention.

For example, the melting and holding furnace of the present invention may be employed for a molten-metal holding furnace having no melting function.

The present application claims priority to Japanese parent application No. 2018-197454, filed on Oct. 19, 2018, which is herein incorporated by reference in its entirety.

REFERENCE NUMERALS

1, 21: melting and holding furnace, 2: melting furnace main body, 3: material input mechanism, 4, 24: melting chamber, 4*a*: upper opening, 5: molten metal receiving chamber, 6: pumping-out chamber, 7, 27: molten metal heating mechanism, 8, 28: melting chamber lid, 9: immersion burner, 29: immersion heater, 30: casting machine, M: molten metal, S: molten-metal surface level sensor

What is claimed is:

1. A melting and holding furnace, comprising:

a melting furnace main body; and a material input mechanism supplying at least one of molten metal and a metal block to the melting furnace main body, wherein the melting furnace main body includes:

a melting chamber for holding the molten metal;

a molten metal receiving chamber communicating with the melting chamber and being supplied with the at least one of the molten metal and the metal block from the material input mechanism;

a pumping-out chamber communicating with the melting chamber and being configured for tapping the molten metal that is introduced from the melting chamber into an external casting machine; and a molten metal heating mechanism heating the molten metal in the melting chamber, wherein the melting chamber includes a melting chamber lid that is installed so as to seal an upper opening of the melting chamber without forming a space between a surface of the molten metal and itself, wherein the material input mechanism includes a molten-metal surface level sensor configured to at least detect that a surface height position of the molten metal in the pumping-out chamber has reached a lower limit set to be above a lower surface height position of the melting chamber lid and at least detect that the surface height position of the molten metal in the pumping-out chamber has reached an upper limit set to be above the lower surface height position of the melting chamber lid, the upper limit being above the lower limit, and wherein, when the molten-metal surface level sensor detects that the surface height position of the molten metal in the pumping-out chamber has reached the lower limit, the material input mechanism supplies the molten metal receiving chamber with the at least one of the molten metal and the metal block until the molten-metal surface level sensor detects that the surface height position of the molten metal in the pumping-out chamber reaches the upper limit so that the surface height position of the molten metal in the pumping-out chamber is always kept above the lower surface height position of the melting chamber lid and the molten metal is always in contact with a lower surface of the melting chamber lid.

2. The melting and holding furnace according to claim 1, wherein the molten metal heating mechanism includes an immersion burner or an immersion heater that is configured to be immersed into the molten metal in the melting chamber on a tip end side thereof, and wherein the immersion burner or the immersion heater is installed so as to extend through the melting chamber lid from above or to extend laterally through an external side wall portion of the melting chamber near a bottom of the melting chamber as a horizontal immersion type.

3. The melting and holding furnace according to claim 1, wherein the upper opening of the melting chamber has an inclined inner peripheral surface that is configured to have an opening area that becomes gradually larger toward an upper side, and wherein the melting chamber lid has an inclined outer peripheral surface corresponding to the inner peripheral surface of the upper opening so that it fits into the upper opening from above.

* * * * *